US008007293B2

(12) United States Patent
Boutin

(10) Patent No.: US 8,007,293 B2
(45) Date of Patent: Aug. 30, 2011

(54) GROUNDING REBAR CONNECTOR

(75) Inventor: Kris R. Boutin, Mont Vernon, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 12/655,385

(22) Filed: Dec. 29, 2009

(65) Prior Publication Data

US 2010/0167565 A1 Jul. 1, 2010

Related U.S. Application Data

(60) Provisional application No. 61/203,899, filed on Dec. 29, 2008.

(51) Int. Cl.
*H01R 4/66* (2006.01)

(52) U.S. Cl. ..... 439/100

(58) Field of Classification Search ..... 439/100, 439/785, 781, 804
See application file for complete search history.

(56) References Cited

U.S. PATENT DOCUMENTS

| | | | | | |
|---|---|---|---|---|---|
| 1,675,163 | A | * | 6/1928 | Colburn | 439/100 |
| 1,986,028 | A | * | 1/1935 | Terry | 439/100 |
| 2,396,119 | A | * | 3/1946 | O'Neil | 439/411 |
| 2,423,714 | A | * | 7/1947 | Leonard | 204/297.15 |
| 2,701,351 | A | * | 2/1955 | Weber | 439/791 |
| 2,777,096 | A | * | 1/1957 | Weisberg | 361/129 |
| 2,942,898 | A | | 6/1960 | Matthysse | |
| 3,046,511 | A | * | 7/1962 | Rinehuls et al. | 439/208 |
| 3,901,577 | A | * | 8/1975 | Philibert et al. | 439/804 |
| 4,114,977 | A | | 9/1978 | Polidori | 339/270 |
| 4,776,808 | A | * | 10/1988 | Davidson | 439/100 |
| D332,939 | S | * | 2/1993 | McDonough, Jr. | D13/149 |
| 5,286,211 | A | | 2/1994 | McIntosh | 439/100 |
| 5,752,860 | A | | 5/1998 | Greaves | 57/224 |
| 5,888,104 | A | * | 3/1999 | Mello et al. | 439/785 |
| 6,581,791 | B2 | * | 6/2003 | Flint et al. | 213/1.3 |
| 6,745,910 | B2 | * | 6/2004 | Flint et al. | 213/1.3 |
| 6,773,198 | B2 | | 8/2004 | Copping | 403/313 |
| 6,871,732 | B2 | * | 3/2005 | Flint et al. | 191/12 R |
| 7,138,580 | B2 | * | 11/2006 | Boutin | 174/84 R |
| 7,341,479 | B2 | * | 3/2008 | Boutin | 439/521 |
| 7,637,754 | B1 | * | 12/2009 | Yerena et al. | 439/108 |
| 7,780,461 | B1 | * | 8/2010 | Vernica | 439/100 |
| 2004/0092142 | A1 | * | 5/2004 | Clark et al. | 439/100 |

(Continued)

OTHER PUBLICATIONS

"Burndy Master Catalog" p. D-28-D-33, D-39, D-41-D-43, D-45, D-46, D-54, FCI USA, Inc., 2007.

*Primary Examiner* — T C Patel
*Assistant Examiner* — Vladimir Imas
(74) *Attorney, Agent, or Firm* — Harrington & Smith

(57) ABSTRACT

Disclosed herein is an electrical connector. The electrical connector includes a bolt member, a first connector member, and a second connector member. The bolt member has a general "U" shape. The first connector member includes a first surface, a second surface, and first openings. The second connector member includes second openings. The second connector member is a one-piece member. The first end and the second end of the bolt member extend through the first and second openings. The electrical connector is adapted to receive a bar member between the bolt member and the first connector member. The electrical connector is adapted to receive an electrical conductor between the first connector member and the second connector member. The first surface of the first connector member is adapted to electrically contact the bar member. The second surface of the first connector member is adapted to electrically contact the electrical conductor.

27 Claims, 4 Drawing Sheets

U.S. PATENT DOCUMENTS

2006/0237214 A1* 10/2006 Boutin ..... 174/92
2006/0240706 A1* 10/2006 Boutin ..... 439/521
2008/0020612 A1* 1/2008 Clark et al. ..... 439/100
2008/0118304 A1 5/2008 Carraher et al. ..... 403/396
2009/0255134 A1* 10/2009 Boutin ..... 30/329
2010/0144173 A1* 6/2010 Wason ..... 439/100
2010/0167565 A1* 7/2010 Boutin ..... 439/100

* cited by examiner

GROUNDING REBAR CONNECTOR

CROSS REFERENCE TO RELATED APPLICATION

This application claims priority under 35 U.S.C. §119(e) to U.S. provisional patent application No. 61/203,899 filed Dec. 29, 2008 which is hereby incorporated by reference in its entirety.

BACKGROUND

1. Field of the Invention

The invention relates to a grounding electrical connector and, more particularly, to a grounding connector for connecting to a rebar.

2. Brief Description of Prior Developments

A rebar is a metal bar (such as steel) which is used inside concrete to form metal reinforced concrete. U.S. Pat. No. 5,752,860 describes a rebar clamp.

SUMMARY

The foregoing and other problems are overcome, and other advantages are realized, by the use of the exemplary embodiments of this invention.

In accordance with one aspect of the invention, an electrical connector is disclosed. The electrical connector includes a bolt member, a first connector member, and a second connector member. The bolt member has a general "U" shape. The bolt member includes a first end and a second end. The first connector member includes a first surface, a second surface, and first openings. The first end and the second end of the bolt member extend through the first openings. The second connector member includes second openings. The second connector member is a one-piece member. The first end and the second end of the bolt member extend through the second openings. The electrical connector is adapted to receive a bar member between the bolt member and the first connector member. The electrical connector is adapted to receive an electrical conductor between the first connector member and the second connector member. The first surface of the first connector member is adapted to electrically contact the bar member. The second surface of the first connector member is adapted to electrically contact the electrical conductor.

In accordance with another aspect of the invention, an electrical connector is disclosed. The electrical connector includes a bolt member, a frame member, and a conductor strap. The bolt member includes a first leg, a second leg, and a first receiving area. The first receiving area is adapted to contact a bar member. The frame member includes a second receiving area. The frame member is connected to the first leg and the second leg of the bolt member. The frame member is adapted to contact an electrical conductor. The conductor strap is between the first leg and the second leg. The conductor strap is adapted to be compressed between the bar member and the electrical conductor. The conductor strap is adapted to provide an electrical connection between the bar member and the electrical conductor.

In accordance with another aspect of the invention, an electrical connector is disclosed. The electrical connector includes a bolt member, a first connector member, and a second connector member. The bolt member includes a first end and a second end. The first connector member includes a groove and first openings. The first end and the second end of the bolt member extend through the first openings. The second connector member includes second openings. The first end and the second end of the bolt member extend through the second openings. The electrical connector is adapted to receive a bar member between the bolt member and the first connector member. The groove of the first connector member is adapted to receive a rib of the bar member. The electrical connector is adapted to receive an electrical conductor between the first connector member and the second connector member.

In accordance with another aspect of the invention, a method is disclosed. A bolt member having a general "U" shape is provided. The bolt member includes a first end and a second end. A first connector member having a first surface, a second surface, and first openings is provided. The first openings are adapted to receive the first end and the second end of the bolt member. The electrical connector is adapted to receive a bar member between the bolt member and the first connector member. The first surface is adapted to electrically contact the bar member. A second connector member having second openings is provided. The second connector member is a one-piece member. The second openings are adapted to receive the first end and the second end of the bolt member. The electrical connector is adapted to receive an electrical conductor between the first connector member and the second connector member. The second surface of the first connector member is adapted to electrically contact the electrical conductor.

BRIEF DESCRIPTION OF THE DRAWINGS

The foregoing aspects and other features of the invention are explained in the following description, taken in connection with the accompanying drawings, wherein.

DETAILED DESCRIPTION

Figure 1:
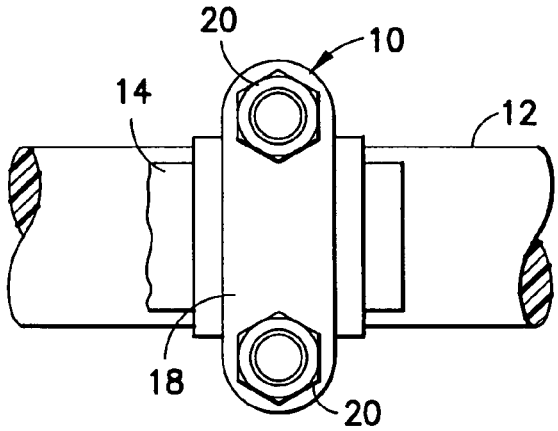
FIG. 1 is a bottom plan view of an electrical connector incorporating features of the invention.

Referring to FIG. 1, there is shown a bottom plan view of an electrical connector 10 incorporating features of the invention shown connected to a rebar 12 and an electrical conductor 14. Although the invention will be described with reference to the example embodiments shown in the drawings, it should be understood that the invention can be embodied in many alternate forms of embodiments. In addition, any suitable size, shape or type of elements or materials could be used.

Figure 3:
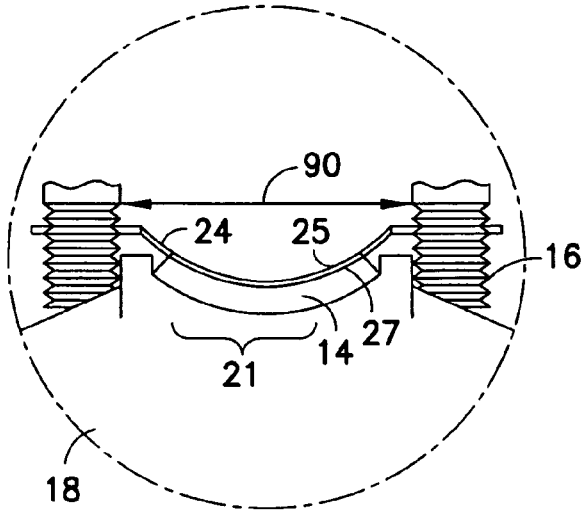
FIG. 3 is an enlarged view of a portion of the connector shown in FIG. 2.
Figure 2:
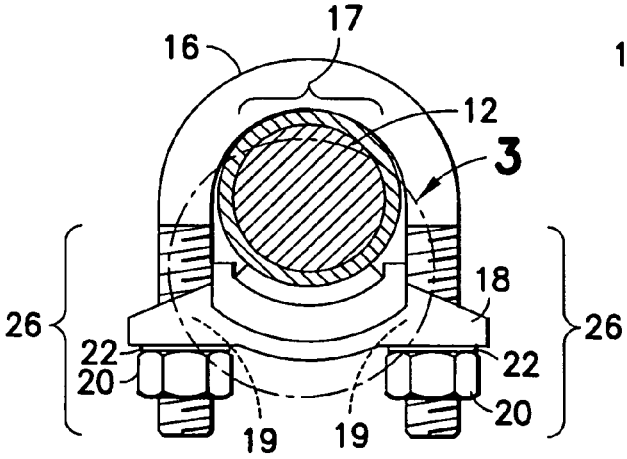
FIG. 2 is a front view of the electrical connector shown in FIG. 1.

Referring also to FIGS. 2-3, the electrical connector 10 generally comprises a U-bolt 16, a frame 18, two nuts 20, two washers 22 and a conductor strap 24. The frame 18 has two spaced holes 19 which the legs 26 of the U-bolt pass through. In this embodiment the conductor 14 runs generally parallel to the rebar 12. However, other configurations may be provided.

Figure 4:
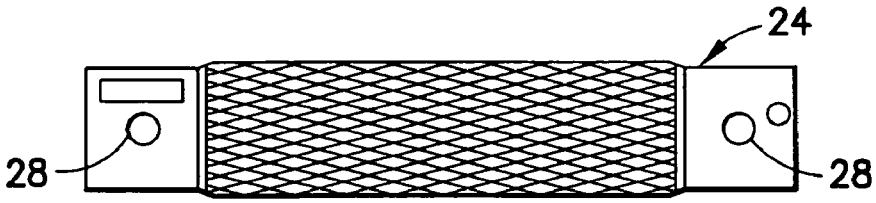
FIG. 4 is a top plan view of a conductor strap used in electrical connector shown in FIG. 1.
Figure 5:
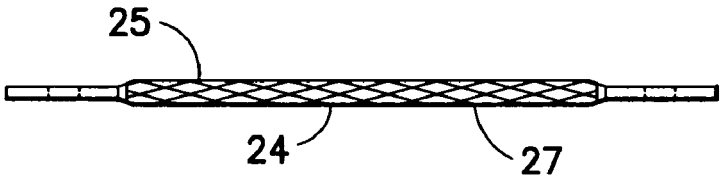
FIG. 5 is side view of the conductor strap shown in FIG. 4.

Referring also to FIGS. 4-5, in this embodiment the strap (or first connector member) 24 comprises a metal braid, such as copper for example. The strap may comprise a one-piece member, for example. However, any suitable configuration may be provided. Ends of the strap 24 have holes (or openings) 28 which are sized and shaped to have the legs (or ends) 26 pass therethrough. The metal braid is configured, such as being malleable for example, to conform to any shape of any rebar exterior surface. The metal braid is able to imprint onto the exterior surface of the rebar.

The frame (or second connector member) 18 may also comprise a one-piece member formed from a conductive material, such as metal, for example. However, any suitable configuration or material may be provided.

When the connector 10 is connected to the rebar 12, the strap 24 is sandwiched between the conductor 14 and the rebar 12. For example, the general "U" shape of the U-bolt 16 forms a receiving area 17 suitably sized and shaped to contact the rebar 12, and a corresponding surface of the frame (or frame member) 18 forms a receiving area 21 suitably sized and shaped to contact the conductor 14. One side (or surface) 25 of the strap 24 conforms to the exterior shape of the rebar while the opposite side (or surface) 27 of the strap conforms to the exterior shape of the conductor 14. The three members 12, 24, 14 are compressed between the U-bolt 16 and the frame 18 as the nuts 20 are tightened. In an alternate embodiment the frame 18 might be configured to have the conductor 14 connected at a different location spaced from the strap 24. The strap 24, because it conforms to the exterior shape of the rebar 12, provides an increased surface area for electrical connection. An increased surface area of contact with the rebar insures better grounding connection between the conductor 14 and the rebar 12.

According to some embodiments of the invention, the strap (and the surfaces 27, 27) extend across at least fifty percent of a distance 90 between the ends 26 of the U-bolt 16. However, in other embodiments any suitable configuration may be provided.

Figure 6:
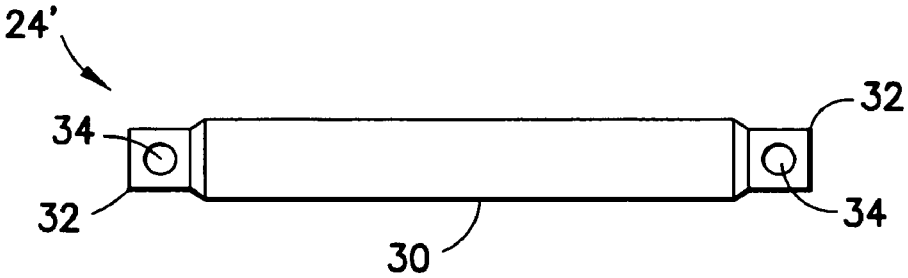
FIG. 6 is a top plan view of an alternate embodiment of a conductor strap used in the electrical connector shown in FIG. 1.
Figure 7:
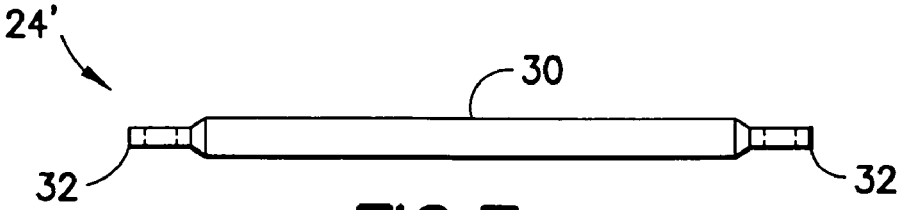
FIG. 7 is side view of the conductor strap shown in FIG. 6.
Figure 8:
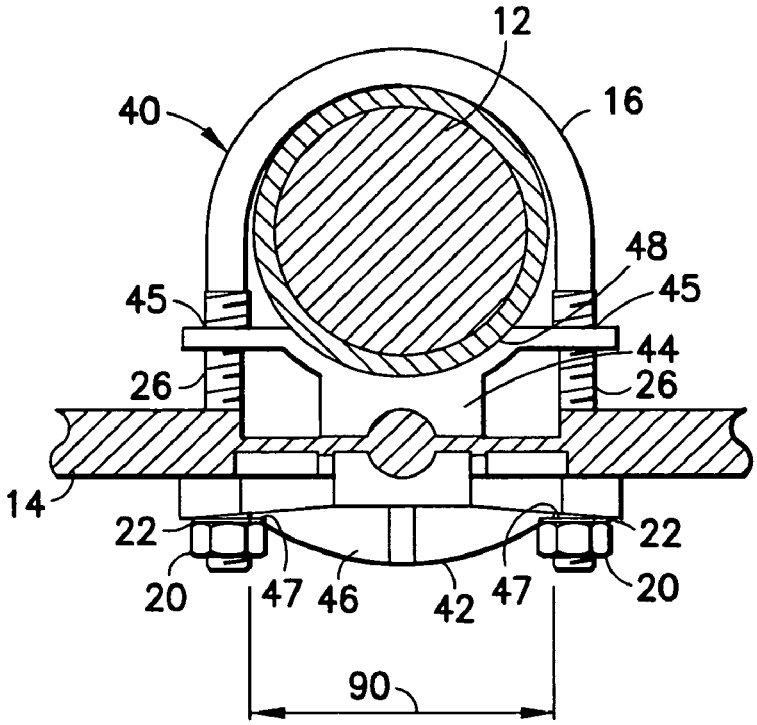
FIG. 8 is front view of an alternate embodiment of an electrical connector incorporating features of the invention.
Figure 9:
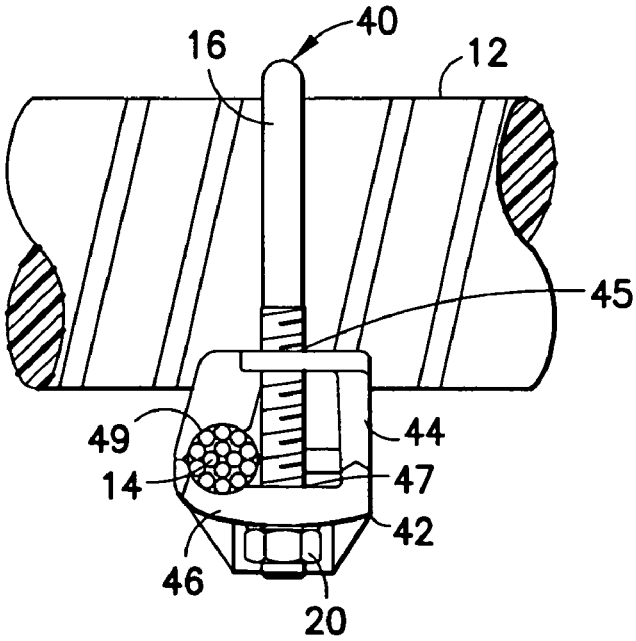
FIG. 9 is side view of the electrical connector shown in FIG. 8.

Referring also to FIGS. 6-7 an alternate embodiment of the strap 24' is shown. In this embodiment the strap 24' comprises a copper foil 30 with ferrules 32 on its ends. The ferrules 32 have holes 34 to accommodate the legs 26 of the U-bolt 16. The copper foil 30 can deform to conform to the exterior surface of the rebar 12 similar to the braid of FIGS. 4-5.

In another alternate embodiment, the strap could comprise a plastic resin with electrically conductive particles, such as carbon particles for example. Alternatively, rather than a strap, the frame 18 could be provided with an inlay of plastic resin with carbon particles which would conform to the exterior shape of the rebar.

Referring now to FIGS. 8-11 another embodiment of the invention is shown. In this embodiment the grounding connector 40 generally comprises a U-bolt 16, a frame 42, two nuts 20 and two washers 22. The frame 42 comprises a first member 44 and a second member 46. The first and second members 44, 46 are sized and shaped to clamp the conductor 14 therebetween. In this embodiment the conductor 14 runs generally perpendicular to the rebar 12.

The first member 44 has two spaced openings 45 which the legs (or ends) 26 of the U-bolt 16 pass through. The first member (or first connector member) 44 may comprise a one-piece member formed from a conductive material, such as metal, for example. However, any suitable configuration or material may be provided.

The second member 46 has two spaced openings 47 which the legs (or ends) 26 of the U-bolt 16 pass through. The second member (or second connector member) may comprise a one-piece member formed from a conductive material, such as metal, for example. However, any suitable configuration or material may be provided.

Figure 10:
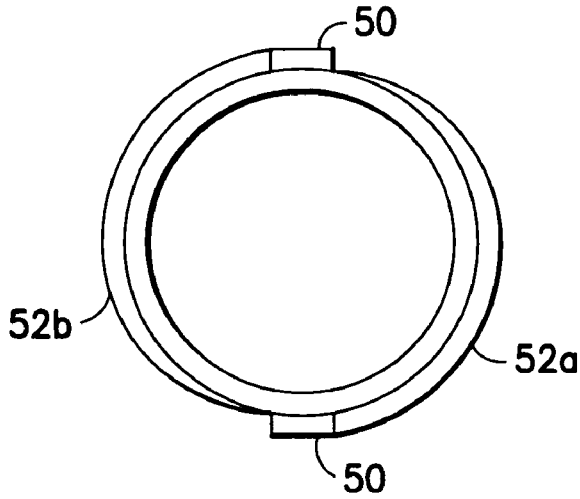
FIG. 10 is a partial section view of a rebar connected to the connector shown in FIG. 8.
Figure 11:
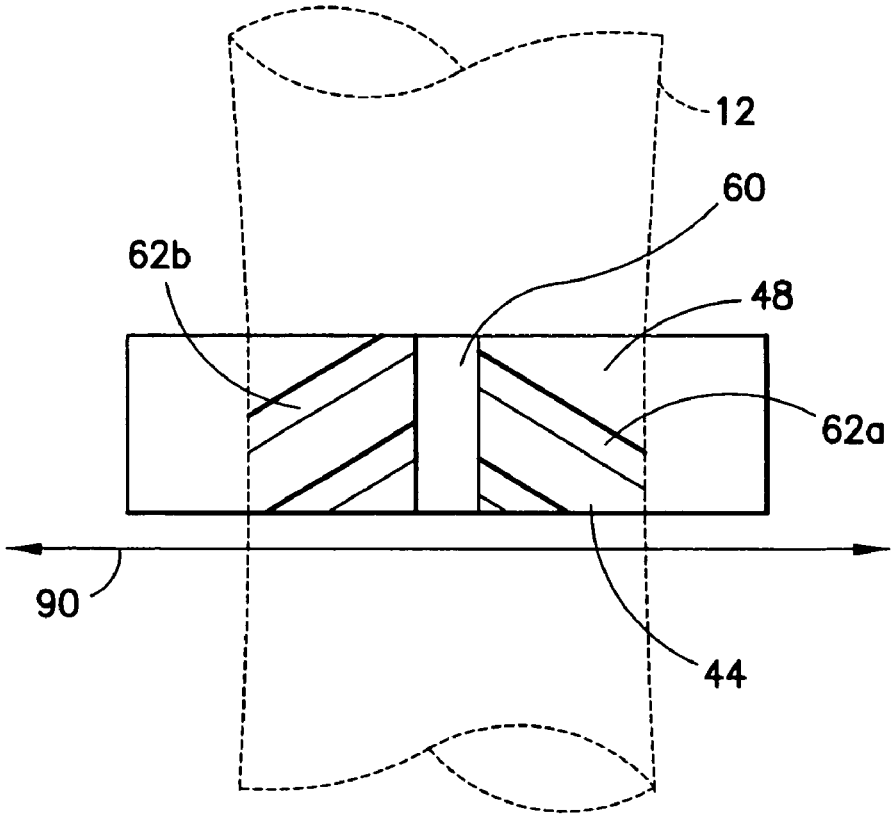
FIG. 11 is a top view of a connector member of the electrical connector shown in FIG. 8.

The top side (or top surface) 48 of the first member 44 is sized and shaped to mate with the exterior surface of the rebar 12. In particular, as shown in FIG. 10 the exterior cross sectional shape of the rebar is irregular. The rebar has elongate ribs 50 on its top and bottom, and angled misaligned ribs 52*a*, 52*b* between the tops and bottom ribs 50. As seen best in FIG. 11, the top side 48 has a groove 60 sized and shaped to matingly receive one of the ribs 50, and grooves 62*a*, 62*b* which are sized and shaped to matingly receive the ribs 52*a*, 52*b*. Thus, when the first member 44 is clamped to the rebar 12, there is an increased area of surface contact between the rebar and the first member 44 because of the surface contact in the grooves 60, 62 and between the grooves on the top side 48.

According to some embodiments of the invention, the top surface 48 (comprising the grooves 60, 62*a*, 62*b*) of the first member 44 extends across at least fifty percent of a distance 90 between the ends 26 of the U-bolt 16. However, in other embodiments any suitable configuration may be provided.

A bottom side (or bottom surface) 49 of the first member 44 is sized and shaped to contact a top side of the conductor 14. Similarly, an opposite surface of the second member 46 is sized and shaped to contact a bottom side of the conductor 14.

According to another example of the invention, a method of manufacturing an electrical connector is disclosed. The method includes the following steps. Providing a bolt member having a general "U" shape, wherein the bolt member comprises a first end and a second end. Providing a first connector member comprising a first surface, a second surface, and first openings, wherein the first openings are adapted to receive the first end and the second end of the bolt member, wherein the electrical connector is adapted to receive a bar member between the bolt member and the first connector member, and wherein the first surface is adapted to electrically contact the bar member. Providing a second connector member comprising second openings, wherein the second connector member is a one-piece member, wherein the second openings are adapted to receive the first end and the second end of the bolt member, wherein the electrical connector is adapted to receive an electrical conductor between the first connector member and the second connector member, and wherein the second surface of the first connector member is adapted to electrically contact the electrical conductor. It should be noted that any of the above steps may be performed alone or in combination with one or more of the steps.

One embodiment of the invention could be used in a fence post grounding connector.

The rebar locator can have recesses to accept rebar ribs to ensure increased conductivity areas. The clamp can have numbs that fit within recesses on the rebar. This can provide mechanical and electrical connection over a larger surface area.

According to one example of the invention, an electrical connector is disclosed. The electrical connector includes a bolt member, a first connector member, and a second connector member. The bolt member has a general "U" shape. The bolt member includes a first end and a second end. The first connector member includes a first surface, a second surface, and first openings. The first end and the second end of the bolt member extend through the first openings. The second connector member includes second openings. The second connector member is a one-piece member. The first end and the second end of the bolt member extend through the second openings. The electrical connector is adapted to receive a bar member between the bolt member and the first connector member. The electrical connector is adapted to receive an electrical conductor between the first connector member and the second connector member. The first surface of the first connector member is adapted to electrically contact the bar member. The second surface of the first connector member is adapted to electrically contact the electrical conductor.

According to another example of the invention, an electrical connector is disclosed. The electrical connector includes a bolt member, a frame member, and a conductor strap. The bolt member includes a first leg, a second leg, and a first receiving area. The first receiving area is adapted to contact a bar member. The frame member includes a second receiving area. The frame member is connected to the first leg and the second leg of the bolt member. The frame member is adapted to contact an electrical conductor. The conductor strap is between the first leg and the second leg. The conductor strap is adapted to be compressed between the bar member and the electrical conductor. The conductor strap is adapted to provide an electrical connection between the bar member and the electrical conductor.

According to another example of the invention, an electrical connector is disclosed. The electrical connector includes a bolt member, a first connector member, and a second connector member. The bolt member includes a first end and a second end. The first connector member includes a groove and first openings. The first end and the second end of the bolt member extend through the first openings. The second connector member includes second openings. The first end and the second end of the bolt member extend through the second openings. The electrical connector is adapted to receive a bar member between the bolt member and the first connector member. The groove of the first connector member is adapted to receive a rib of the bar member. The electrical connector is adapted to receive an electrical conductor between the first connector member and the second connector member.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electrical connector comprising:

a bolt member having a general "U" shape, wherein the bolt member comprises a first end and a second end;

a first connector member comprising a first surface, a second surface, and first openings, wherein the first end and the second end of the bolt member extend through the first openings; and a second connector member comprising second openings, wherein the second connector member is a one-piece member, and wherein the first end and the second end of the bolt member extend through the second openings;

wherein the electrical connector is adapted to receive a bar member between the bolt member and the first connector member, wherein the electrical connector is adapted to receive an electrical conductor between the first connector member and the second connector member, wherein the first surface of the first connector member is adapted to electrically contact the bar member, wherein the second surface of the first connector member is adapted to electrically contact the electrical conductor, and wherein a majority of an edge of the second surface extending adjacent to the first openings is substantially spaced from the second connector member, wherein the first connector member comprises a conductor strap, and wherein the conductor strap comprises a plastic resin with electrically conductive particles.

2. An electrical connector as in claim 1 wherein the first surface of the first connector member extends across at least fifty percent of a distance between the first end and the second end of the bolt member.

3. An electrical connector as in claim 1 wherein the first connector member is a one-piece member.

4. An electrical. connector as in claim 1 wherein the second connector member comprises at least a portion of a grounding connector frame.

5. An electrical connector as in claim 1 wherein the first surface of the first connector member extends across at least fifty percent of a distance between the first end and the second end of the bolt member, and wherein the first connector member is a one-piece member.

6. An electrical connector as in claim 5 wherein the second connector member comprises at least a portion of a grounding connector frame.

7. An electrical connector as in claim 6 wherein the electrical connector is adapted to receive a rebar member between the bolt member and the first connector member.

8. An electrical connector as in claim 1 wherein the conductor strap is configured to conform to an exterior shape of the bar member.

9. An electrical connector as in claim 1 wherein the first connector member comprises a grounding connector frame member.

10. An electrical connector as in claim 1 wherein the electrical connector is adapted to receive the electrical conductor in a substantially parallel orientation relative to the bar member.

11. An electrical connector comprising:

a bolt member comprising a first leg, a second leg, and a first receiving area, wherein the first receiving area is adapted to contact a bar member;

a frame member comprising a second receiving area, wherein the frame member is connected to the first leg and the second leg of the bolt member, and wherein the frame member is adapted to contact an electrical conductor, and a conductor strap between the first leg and the second leg, wherein the conductor strap comprises a plastic resin with electrically conducive particles, wherein the conductor strap is adapted to be compressed between the bar member and the electrical conductor, wherein the conductor strap is configured to conform to an exterior shape of the bar member, and wherein the conductor strap is adapted to provide an electrical connection between the bar member and the electrical conductor.

12. An electrical connector as in claim 11 wherein the bolt member comprises a general "U" shape.

13. An electrical connector as in claim 11 wherein the conductor strap comprises a metal braid.

14. An electrical connector as in claim 11 wherein the first receiving area is adapted to contact a rebar member, and wherein the conductor strap is adapted to provide an electrical connection between the rebar member and the electrical conductor.

15. An electrical connector as in claim 11 wherein the conductor strap comprises a one-piece member having openings at ends of the conductor strap, and wherein the first end and the second end of the bolt member extend through the openings of the conductor strap.

16. An electrical connector as in claim 11 wherein the conductor strap comprises a copper foil with ferrules on opposite ends of the straps.

17. An electrical connector as in claim 11 wherein the electrical connector is adapted to receive the electrical conductor in a substantially parallel orientation relative to the bar member.

18. An electrical connector comprising:

a bolt member comprising a first end and a second end;

a first connector member comprising a groove and first openings, wherein the first end and the second end of the bolt member extend through the first openings; and a second connector member comprising second openings, wherein the first end and the second end of the bolt member extend through the second openings;

wherein the electrical connector is adapted to receive a bar member between the bolt member and the first connector member, wherein the groove of the first connector member is adapted to receive a rib of the bar member, wherein the first connector member comprises another groove, wherein the another groove is adapted to receive another rib of the bar member, and wherein the electrical connector is adapted to receive an electrical conductor between the first connector member and the second connector member.

19. An electrical connector as in claim 18 wherein the bolt member comprises a general "U" shape.

20. An electrical connector as in claim 18 wherein the grooves are angled relative to each other.

21. An electrical connector as in claim 18 wherein the electrical connector is adapted to receive a rebar member between the bolt member and the first connector member, and wherein the groove of the first connector member is adapted to receive a rib of the rebar member.

22. An electrical connector as in claim 18 wherein the first connector member comprises a first frame member.

23. An electrical connector as in claim 18 wherein the second connector member comprises a second frame member.

24. An electrical connector as in claim 18 wherein the electrical connector is adapted to receive the electrical conductor in a substantially perpendicular orientation relative to the bar member.

25. A method comprising:

providing a bolt member having a general "U" shape, wherein the bolt member comprises a first end and a second end;

providing a first connector member comprising a first surface, a second surface, a groove, and first openings, wherein the first openings are adapted to receive the first end and the second end of the bolt member, wherein the electrical connector is adapted to receive a bar member between the bolt member and the first connector member, and wherein the first surface is adapted to electrically contact the bar member; and providing a second connector member comprising second openings, wherein the second connector member is a one-piece member, wherein the second openings are adapted to receive the first end and the second end of the bolt member, wherein the electrical connector is adapted to receive an electrical conductor between the first connector member and the second connector member, wherein the second surface of the first connector member is adapted to electrically contact the electrical conductor, wherein the groove of the first connector member is adapted to receive a rib of the bar member, and wherein the first connector member comprises another groove, wherein the another groove is adapted to receive another rib of the bar member.

26. A method as in claim 25 wherein the first surface of the first connector member extends across at least fifty percent of a distance between the first end and the second end of the bolt member.

27. A method as in claim 25 wherein the providing of the first connector member further comprises providing a grounding connector frame member, wherein the electrical connector is adapted to receive a rebar member between the bolt member and the grounding connector frame member.

* * * * *